United States Patent [19]

Vandoros

[11] Patent Number: 4,593,839

[45] Date of Patent: Jun. 10, 1986

[54] GARMENT STRETCHER

[76] Inventor: Steven J. Vandoros, 164-39 95th St., Howard Beach, N.Y. 11414

[21] Appl. No.: 707,470

[22] Filed: Mar. 1, 1985

[51] Int. Cl.[4] ..... D06C 5/00; A47J 51/08

[52] U.S. Cl. ..... 223/63; 223/95

[58] Field of Search ..... 223/63, 61, 96, 95

[56] References Cited

U.S. PATENT DOCUMENTS

| | | | |
|---|---|---|---|
| 362,495 | 5/1887 | Crommer | 223/63 |
| 666,235 | 1/1901 | Osgood | 223/95 |
| 695,924 | 3/1902 | Grotenhuis | 223/96 |
| 798,547 | 8/1905 | Walsh | 223/61 |
| 2,418,083 | 3/1947 | Mayer | 223/63 |
| 2,616,596 | 11/1952 | Nicholas | 223/96 |
| 2,663,881 | 12/1953 | Mira | 223/61 |
| 2,835,421 | 5/1958 | Marchese | 223/61 |
| 2,918,201 | 12/1959 | Marrocco | 223/95 |
| 4,529,109 | 7/1985 | Manning | 223/61 |

FOREIGN PATENT DOCUMENTS

| | | | |
|---|---|---|---|
| 2120542 | 12/1983 | United Kingdom | 223/95 |

*Primary Examiner*—Louis K. Rimrodt
*Assistant Examiner*—Joseph S. Machuga
*Attorney, Agent, or Firm*—Natter & Natter

[57] ABSTRACT

Apparatus and method for stretching a localized area of a garment. The apparatus comprises a pair of pads and a pair of screws engaged with a barrel for forcibly urging the pads away from one another to stretch the localized area. The pads engage only a localized area of the garment, and are retained against rotation by the area itself.

10 Claims, 4 Drawing Figures

GARMENT STRETCHER

BACKGROUND OF THE INVENTION

Reference is hereby made to a Disclosure Document of the inventor deposited at the U.S. Patent and Trademark Office on Apr. 2, 1984 and accepted under the Disclosure Document program (Deposit No. 126, 115). It is hereby requested that this document be preserved beyond the two year period The present invention relates to apparatus and methods for stretching garments. Many garments are made from textiles such as common denim which shrink during washing or drying. It has become fashionable to wear trousers, especially those of denim, in a close or tight fit. A common method of producing a tight fit has been to don denim trousers after the same have shrunk, so that the shrunken trousers stretch again to fit the wearer's body.

The waistband of the shrunken trousers has heretofore caused difficulties in this procedure. Ordinarily, the waistband is reinforced and hence strongly resists stretching as the wearer dons the garment. Because the waistband offers greater resistance to stretching than the remainder of the garment, it has heretofore been difficult to attain a satisfactory fit. If the trousers are shrunk to the extent needed for a close fit of the hips and seat, the waistband may be too tight and indeed may be impossible for the wearer to don and close.

Attempts to stretch the waistband manually before donning have typically been futile. Few wearers have sufficient strength to stretch the waistband manually. Although numerous devices for stretching garments have been proposed, none of these have provided a satisfactory solution to the difficulties discussed above. The devices heretofore proposed have typically been arranged to hold and stretch the entire garment, and hence are cumbersome and complex.

SUMMARY OF THE INVENTION

The present invention provides solutions for the problems involved in fitting trousers and like garments closely on the wearer's body.

The present invention incorporates the realization that devices and methods for adjusting trousers need only operate primarily on a localized area of the garment, e.g., the waistband.

One aspect of the present invention provides an extraordinarily simple and compact device for adjusting the fit of trousers. The device preferably includes a barrel and two rods or members, each of which extends from one end of the barrel along the longitudinal axis of the barrel. Each rod has a pad on its end remote from the barrel, a distal surface on each pad facing away from the barrel for engagement with an area of the garment, for example, the waistband. The pads are preferably dimensioned to engage only the localized region of the garment. The device includes means for spreading the pads apart from one another upon rotation of the barrel about its longitudinal axis.

Preferably, the barrel has left-hand threads at one end and right-hand threads at the other end, the rods being engaged with the threads. Thus, if the rods are restrained against rotation about the axis, rotation of the barrel in one direction will move the rods in opposite directions, thereby forcing the pads apart and stretching the waistband.

In the preferred arrangement, the waistband itself aids in restraining the rods against rotation about the axis. When the waistband is tight on the pads, the waistband is resistant to twisting on itself about the axis. Thus, the pads engaged with the waistband are restrained against rotation relative to one another about the axis, and the rods connected to the pads are likewise restrained against rotation relative to one another. By grasping either one pad or the garment in one hand, the user may restrain both rods against rotation about the axis, leaving the other hand free to rotate the barrel and thus stretch the waistband.

Accordingly, there is no need to provide any auxiliary structure for restraining the rods against rotation about the axis. The rods preferably are connected to one another solely by way of the barrel. This arrangement provides a simple, compact and inexpensive device.

Moreover, because the pads can rotate relative to one another about the axis before the device is firmly engaged with the waistband, the pads tend to align themselves during engagement so that the waistband is properly seated on the pads. If the distal waistband engaging surface of each pad has a saddle-like shape defining a depression, the waistband tends to become seated in the depressions. This self-aligning capability tends to reduce stress on the garment and simplifies use of the device.

Preferably, the device is arranged to retain the garment in the stretched condition after the user has adjusted it. Thus, the garment may be stretched while wet and the device with the garment on it may be hung up while the garment dries.

The present invention also provides improvements in methods of fitting trousers. Because only the waistband usually needs to be stretched before donning, the remainder of the garment provides the desired fit. If alternatively, another localized area such as the hip portion of the garment requires stretching for a desired fit, then only that area of the garment is stretched upon placement of the device in the hip portion.

DETAILED DESCRIPTION OF THE PREFERRED EMBODIMENTS

Figure 1:
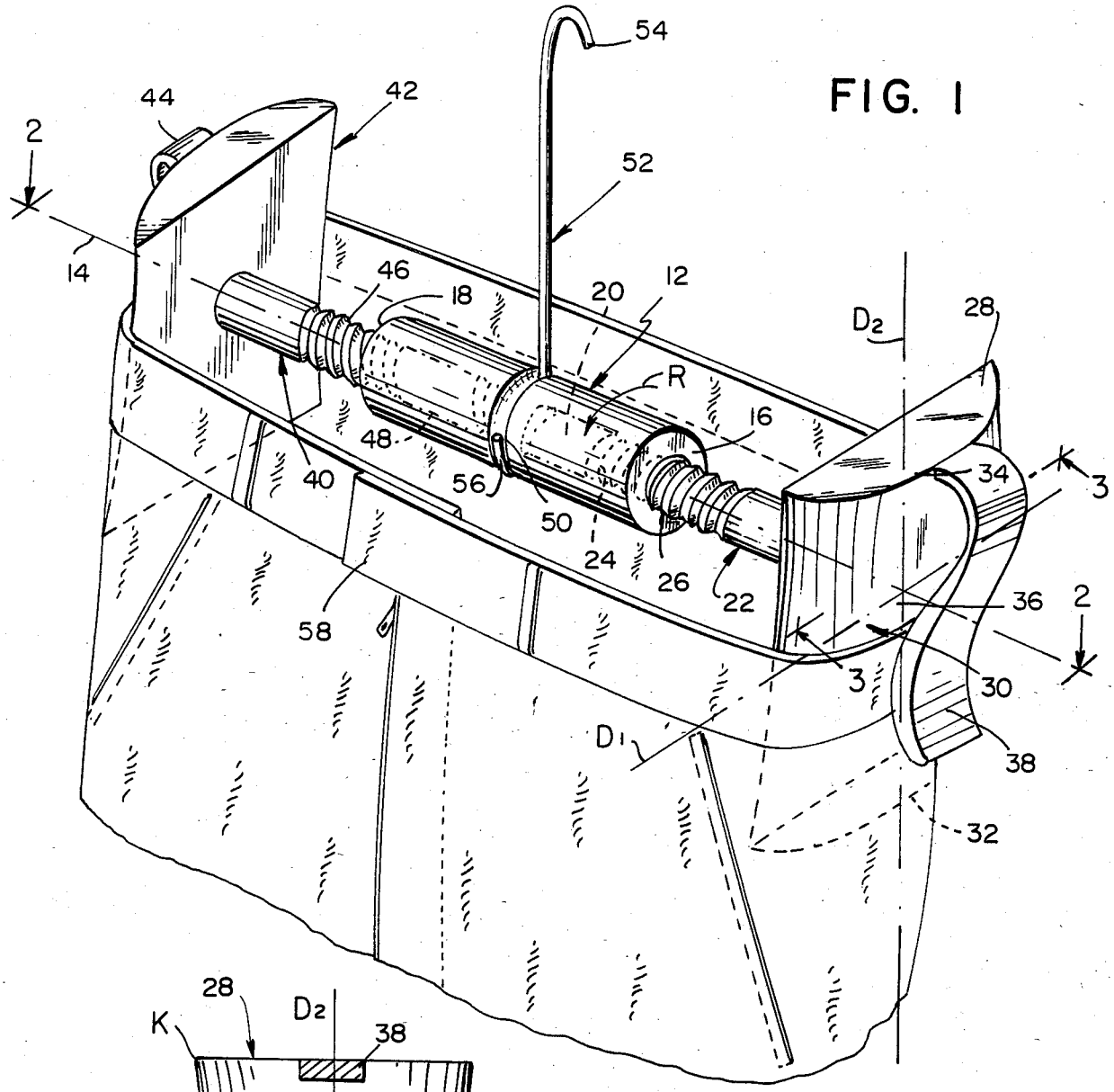
FIG. 1 is a perspective view of apparatus according to one embodiment of the present invention engaged with a garment.

A device according to one embodiment of the present invention includes a barrel 12 having a first end 16, a second end 18 and a longitudinal axis 14 extending through the ends. A bore 20 extends axially through the barrel. A first member or rod 22 extends from the first end of the barrel along axis 14. The axial bore of the barrel is provided with left-hand female threads 24 adjacent first end 16. Rod 22 has left-hand male threads on its proximal end 26, which are engaged in the threads in the bore.

A pad 28 is fixed to the distal end of first rod 22, remote from the barrel. The pad has a distal surface 30 facing away from the barrel which is convex in a first or widthwise direction, shown as horizontal direction $D_1$ in FIGS. 1 and 3. Distal surface 30 is concave in a second or heightwise direction $D_2$ (the vertical direction in FIGS. 1 and 3) orthogonal to axis 14 and to $D_1$. Surface 30 thus has a saddle-like configuration and is generally symmetrical about axis 14. The surface defines a pair of lips 32 and 34 protruding away from the barrel along axis 14 at the lower and upper extremities of the pad 32 with a groove or depression 36 between the lips, at axis 14. A resilient clip 38 is attached to pad 28 at lip 34, the clip confronting distal surface 30. The resilience of the clip biases it towards surface 30. A second member or rod 40 extends axially from the second end 18 of the barrel. Second rod 40 has a pad 42 fixed to its distal end, there being a clip 44 mounted to such pad. The second rod and the pad and clip associated therewith are identical to the corresponding features associated with first rod 22, save that the second rod 40 has right-hand male threads 46 at its proximal end, which are engaged in right-hand female threads 48 in the bore of the barrel, adjacent end 18.

An annular groove 50 is formed in the exterior surface of the barrel and extends about axis 14 adjacent the mid-point of the barrel between ends 16 and 18. A hook 52 having a distal portion 54 shaped to receive a bar or line and an arcuate proximal portion 56 extends outwardly from the barrel, transversely to axis 14. The proximal portion of the hook is engaged in annular groove 50 so that the hook is free to rotate with respect to the barrel about axis 14.

In operation, the device is adjusted to a size close to the size of the waistband, as by rotating the barrel relative to one or both of the rods. A localized area of a garment such as the waistband 58 is then fastened closed by the fasteners incorporated in the garment, and positioned on pads 28 and 42 so that barrel 12 and rods 22 and 40 are disposed within the waistband. Part of the waistband is engaged between clip 38 and distal surface 30 on pad 28, whereas an opposite portion of the waistband is engaged between clip 44 and the distal surface of pad 42.

Figure 2:
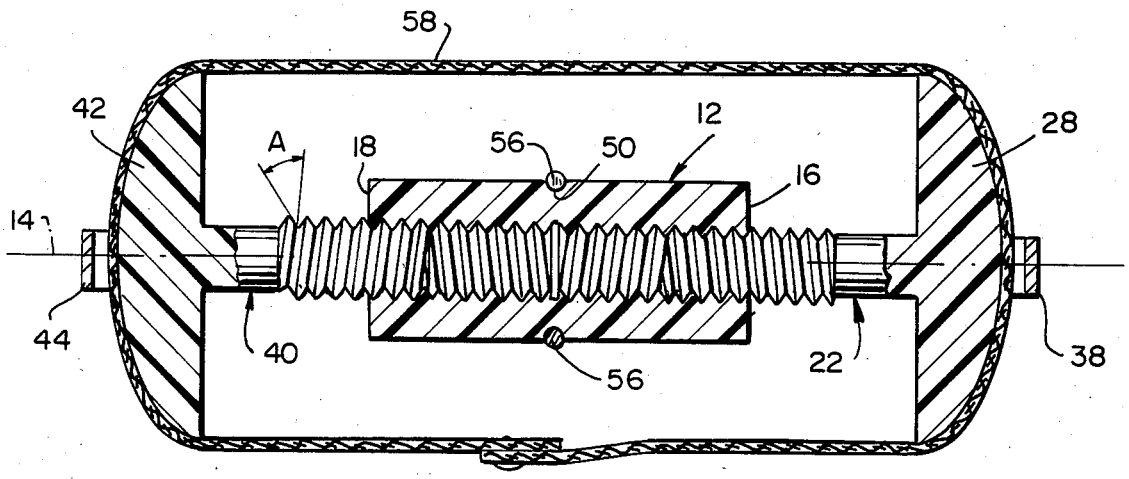
FIG. 2 is a view taken along line 2—2 in FIG. 1.

As illustrated in FIG. 2, the width W of pad 38 (its dimension in direction $D_1$, FIGS. 1 and 3) is greater than the diameter of the barrel 12, i.e., the width of each pad is greater than the greatest dimension of the barrel transverse to axis 14. Likewise, the width of each pad is greater than the diameter of each of rods 22 and 40. Thus, the edges of the pads hold the waistband away from the barrel and rods and the waistband. The user accordingly may insert his hand within the waistband, grip the barrel and rotate it in direction R (FIG. 1) about axis 14, thereby moving pads 28 and 42 away from one another to stretch the waistband.

The waistband itself constrains the pads 42 and 28 against rotation relative to one another about axis 14. The pads may rotate slightly upon initial rotation of the barrel. However, once the pads rotate into alignment with the waistband they become engaged with the waistband. Any further rotation of the pads would require the waistband to twist on itself and hence would shorten the waistband, tightening it further on the pads. Any such twisting thus becomes self-limiting. Once the waistband becomes firmly engaged with the pads, the pads cannot rotate further relative to one another. Because rod 22 is fixed to pad 28, and rod 40 is fixed to pad 42, neither of the rods may rotate about axis 14 relative to the associated pad. Thus when the waistband is taut, the pads and rods are locked together against relative rotation by the waistband. By grasping one pad in one hand, the user can restrain both pads and both rods against rotation about axis 14. Thus, when the user turns the barrel about the axis with his other hand, the rods do not turn with the barrel.

Figure 3:
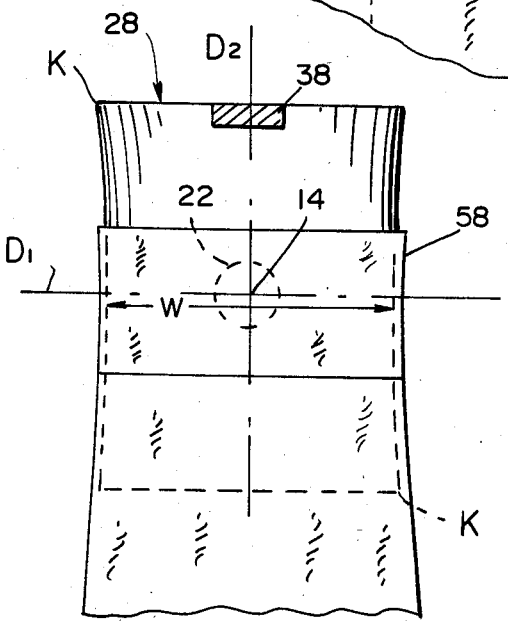
FIG. 3 is a view taken along line 3—3 in FIG. 1.

Secure interengagement of the pads with the waistband is most desirable to keep the pads, and hence the rods, from rotating about axis 14 upon rotation of the barrel. The shape of the pads used in the illustrated embodiment contributes to the security of engagement. As seen in FIG. 3, an end view along axis 14, pad 28 is generally rectangular. The waistband is disposed along the widthwise dimension W of the pad. Rotation of the pad relative to the waistband about axis 14 would move the corners K of the pad into alignment with the waistband, and hence would place the waistband along the diagonal dimension of the pad. Any such relative motion would further stretch the waistband, and is accordingly resisted by the waistband.

The shape of the distal surface on each pad further contributes to the secure engagement of the pads with the waistband. The lips 32 and 34 on the distal surface of pad 28 cup the waistband between them. As barrel 12 is rotated in direction R, the lower lip 32 tends to swing upwardly out of the waistband. But any such movement of the lip relative to the waistband would further stretch the waistband and is accordingly resisted by the waistband. Rather, as the tension on the waistband increases, the waistband tends to become more firmly seated in the depression 30 between the lips on pad 28, and in the corresponding depression on the distal surface at pad 42.

The pitch of the threads on the rods and barrel is also selected to assure that the rods do not turn with the barrel but instead move axially upon rotation of the barrel. Thus, the lead of the threads (the linear distance corresponding to one turn) is preferably about $\frac{1}{4}''$ for threads having a major diameter of about $\frac{7}{8}''$. The helix angle A of each thread (the angle between the thread and a line perpendicular to axis 14, as seen in FIG. 2) may be about 1.48°. Such gently sloping threads maximize the axial force applied to the rods and minimize the torque tending to turn the rods about axis 14 upon rotation of the barrel.

Moreover, the gentle slope of the threads assures that they are "self-locking," i.e., that inwardly-directed axial forces applied to the pads and rods by the waistband will not create sufficient torque on the barrel to rotate it relative to the rods and hence permit the rods to move axially inwardly toward one another. Thus, once the rods have been forcibly displaced outwardly by rotation of the barrel, they will retain their position until released by deliberate reverse rotation of the barrel. The rods will not slip inwardly when the user releases his grip on the barrel. The user may grip the barrel and rotate it, then momentarily release his grip to adjust the position of his hand and then further rotate the barrel to progressively stretch the waistband. Once stretched, the waistband will remain stretched indefinitely.

Because both rods are threadedly engaged with the barrel, the spreading motion of the pads for a given rotation of the barrel is double that achieved by a single thread of comparable lead. Thus, the necessary spreading can be achieved without excessive and tiresome rotation of the barrel. Because the pads preferably are dimensioned to engage only the waistband and the immediately adjacent region of the garment, the force which must be applied by the pads to the garment is limited, and the torque which need be applied to the barrel to move the pads is correspondingly limited.

Pads having a maximum dimension less than about $3\frac{1}{8}$ inches will satisfactorily engage a typical waistband without engaging areas of the garment remote from the waistband.

Hook 52 does not interfere with rotation of the barrel during stretching. The hook is freely rotatable about axis 14 with respect to the barrel. Thus, if the hook is initially positioned so that it points upwardly out of the garment, it will come to rest against the waistband as the barrel is first rotated, and then remain in position as the barrel is further rotated. The device, with the garment stretched thereon, may be hung from the hook after stretching.

Figure 4:
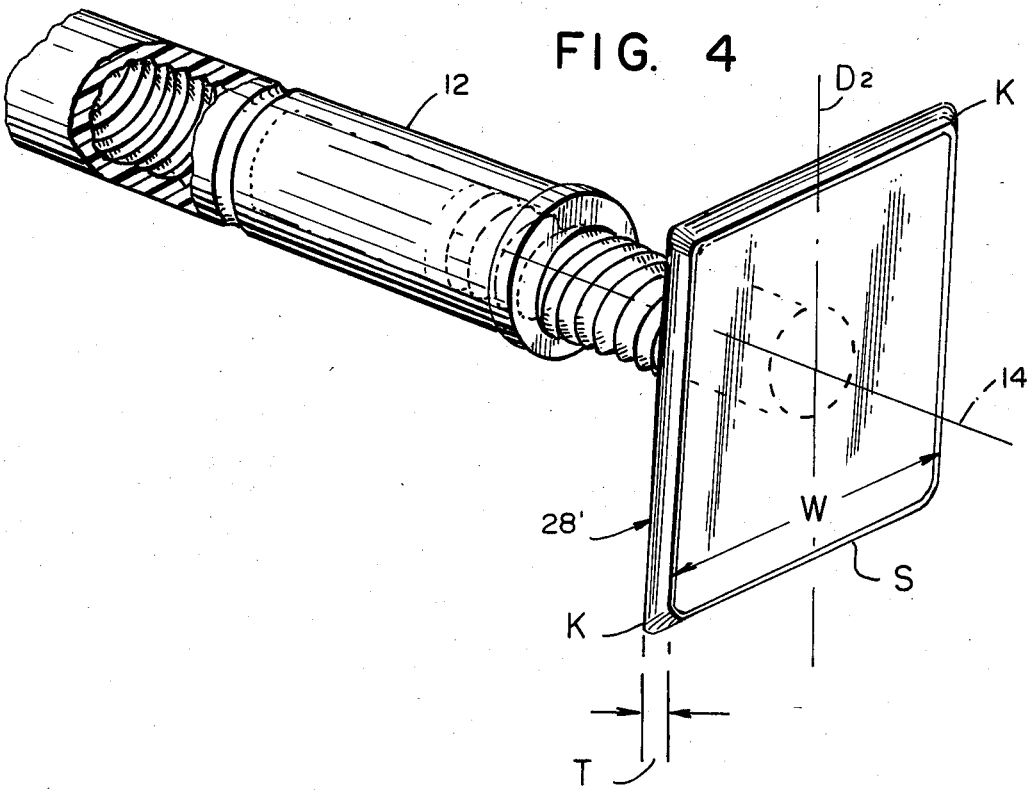
FIG. 4 is a fragmentary perspective view of apparatus according to another embodiment of the present invention.

Apparatus according to another embodiment of the present invention, shown in FIG. 4, is generally similar to that illustrated in FIGS. 1–3, but has generally square pads, of which one, 28' is shown. Although the pads have slightly rounded corners, the diagonal distance between opposite corners K is greater than the width W of the pad. Any rotation of either square pad relative to the waistband about axis 14 would move corners K of the square pad toward the position occupied by sides S of the pad shown in FIG. 4. As described above with reference to FIG. 3, this movement would place the waistband along the greater diagonal dimension of the pad, further stretching the waistband. Thus, the waistband will constrain these square pads against rotation relative to one another about axis 14, even though the distal surface of each pad does not have a saddle-like shape. When engaging the device illustrated in FIG. 4 with a localized area of a garment, any of the four sides of either pad may be facing in the upward direction along $D_2$. This facilitates insertion of the device. Moreover, the absence of a resilient clip from the pad renders the square pad more appropriate for stretching garment regions remote from garment openings, e.g., the hip portion of a pair of trousers. In these regions, clips are unable to grip the garment exterior, and hence could serve no purpose.

In this embodiment, the square pads may measure $3\frac{1}{8}''$ per side S and may have a dimension T of $\frac{1}{4}''$ along axis 14. The barrel may have a diameter of $1\frac{1}{8}''$ and length of $8\frac{3}{8}''$. It has been found that a device with these dimensions may stretch a wide variety of garment waist sizes, ranging from size 24 to 38.

Numerous variations and combinations of the features set forth above may be used without departing from the present invention. For example, although the embodiment illustrated employs rods or members 22 and 40 having male threads and a barrel 12 having female threads, the reverse arrangement may be used. Thus, each of the members interposed between the pads and the barrel may be a collar-like structure having female threads, the barrel itself having male threads. If the members have female threads, they may be recessed within the pads. Accordingly, the foregoing description should be taken as merely illustrative of the invention as defined in the claims.

I claim:

1. A garment stretcher adapted for distending a localized region of a garment such as a waistband dimension comprising a barrel member having two ends and defining a longitudinal axis, said barrel member being removably insertable within the garment, a first rod member including a proximal end threadably engageable with one end of said barrel member, and a second rod member including a second proximal end threadably engageable with the other end of said barrel member, pad means for engaging the garment, said pad means being mounted at a distal end of each of said rod members, said pad means further having a width dimension transverse to the longitudinal axis, said width dimension being greater than the transverse width dimension of the barrel member for spacing the garment transversely from the barrel member so as to provide access for hand engagement of the barrel member, said pad means being rotatable about the longitudinal axis for engaged alignment with the localized region of the garment, rotational means for generating a distention force along the longitudinal axis of the barrel member, whereby said pad means are extendably displaceable from the respective ends of the barrel member to stretch the garment.

2. A garment stretcher as claimed in claim 1 further including support means without the garment, said support means being releasably attachable to the barrel member.

3. A garment stretcher as claimed in claim 2 wherein the support means comprises a hook mounted to the barrel member and extending from the barrel member transversely to said longitudinal axis, said hook being rotatable about said axis with respect to the barrel member.

4. A garment stretcher as claimed in claim 3 wherein said barrel member has an annular groove on its exterior surface extending about said longitudinal axis, said hook having a loop engaged in said annular groove.

5. A garment stretcher as claimed in claim 1 wherein said pad means includes a distal surface facing away from the barrel member, said distal surface being substantially planar.

6. A garment stretcher as claimed in claim 5 wherein the distal surface of each pad means is concave in a first direction orthogonal to the barrel member axis and convex in a second direction orthogonal to both the barrel member axis and to the first direction.

7. A garment stretcher as claimed in claim 1 wherein said barrel member has left-hand threads extending about said longitudinal axis at one end and right-hand threads extending about said axis at the other end, one of the rod members being engaged with said left-hand threads at one end of the barrel member and the other of the rod members being engaged with said right-hand threads at the other end of the barrel member, the rotational means for generating a distention force including the threads, each of the rod members being constrained against rotation about the longitudinal axis with respect to the associated pad means.

8. A garment stretcher as claimed in claim 7 wherein the threaded engagement of the barrel member with each rod member is self-locking.

9. A garment stretcher as claimed in claim 7 further comprising two clips, each of said clips being associated with respective pad means and means for biasing each clip toward the respective pad means.

10. A garment stretcher as claimed in claim 1 wherein the width of each pad means in a direction transverse to said longitudinal axis is greater than the greatest dimension of the barrel member.

* * * * *